US005679616A

United States Patent [19]

Payne

[11] Patent Number: 5,679,616

[45] Date of Patent: Oct. 21, 1997

[54] PRINTING PROCESS

[76] Inventor: John M. Payne, Southgate House, High Street, Maxey, Peterborough, United Kingdom, PE6 9EE

[21] Appl. No.: 166,934

[22] Filed: Dec. 15, 1993

Related U.S. Application Data

[63] Continuation-in-part of Ser. No. 721,501, Jul. 10, 1991, abandoned.

[30] Foreign Application Priority Data

Jan. 13, 1989 [GB] United Kingdom ..... 8900747

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | | |
|---|---|---|---|
| 4,006,026 | 2/1977 | Dahms | 106/14 |
| 4,053,344 | 10/1977 | Hirahara | 156/247 |
| 4,724,026 | 2/1988 | Nelson | 156/233 |
| 4,868,049 | 9/1989 | Nelson | 428/328 |

FOREIGN PATENT DOCUMENTS

| | | | |
|---|---|---|---|
| 0 191 592 | 8/1986 | European Pat. Off. | 428/195 |
| 1207408 | 12/1965 | Germany | 503/227 |
| 60-82393 | 5/1985 | Japan | 503/227 |

*Primary Examiner*—B. Hamilton Hess
*Attorney, Agent, or Firm*—Nixon & Vanderhye

[57] ABSTRACT

A dye donor sheet comprising a dye resisting substrate, a release layer coating thereon, on which is coated a continuous layer of sublimation dye which is coated over substantially the entire surface of the release layer and incorporating at least in its surface a bonding medium which is capable of causing the dye to adhere to the thermoplastic print of a printed sheet placed in contact with the layer of dye and subjected to heat and pressure, thereby to produce a dye transfer sheet.

3 Claims, 7 Drawing Sheets

PRINTING PROCESS

This is a continuation-in-part of application Ser. No. 07/721,501, filed Jul. 10, 1991, now abandoned.

FIELD OF THE INVENTION

This invention concerns a printing process by which dyes and inks are transferred to sheet material using an intermediate transfer sheet containing the printing material.

BACKGROUND OF THE INVENTION

Conventionally a sublimation dye (eg as supplied by Ciba-Geigy Ltd), is printed onto paper using for example silk screen, flexographic or lithographic processes. This is printed in reverse as it will be used as a transfer sheet.

This transfer sheet is placed with its printed surface next to the surface to be sublimation printed. The surface is usually a man-made polymer, one of the most suitable being polyester, such as that made by ICI having the brand name "Melinex" (trade mark).

The transfer sheet and the polyester sheet are then put under light pressure and heated to a temperature of about 180° C. for about 1 minute. Molecules of the dye migrate into the structure of the polyester.

The above mentioned process for printing transfer sheets is suitable for large quantities of prints, but where small quantities are required, making the silk screens or lithographic plates etc, is not always fast enough or cost effective to make it viable.

The present invention seeks to provide methods which are an improvement over existing methods by speed, cost, and/or print quality.

BRIEF DESCRIPTION OF THE DRAWINGS

The invention is further described with reference to the attached drawings in which.

SUMMARY OF THE INVENTION

According to the present invention a dye donor sheet comprises a dye resisting substrate having coated thereon a layer of sublimation dye having a bonding medium in at least its surface, which will cause the dye to adhere to thermoplastic material placed in contact therewith (eg the fused toner of a photocopy).

The invention will now be described by way of a series of examples of this and other methods embodying the invention and of developments and extensions of that method.

1. Making a Dye Transfer Sheet Using a Photocopy

By photocopy is meant any copy using fused toner and includes a laser printer copy.

Figure 1:
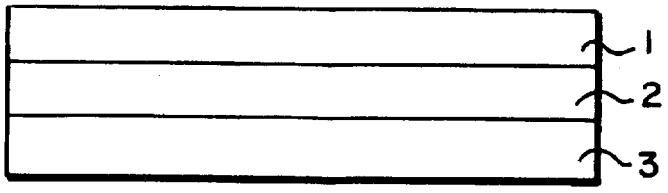
FIG. 1 is a cross-sectional view of dye donor transfer sheet.
Figure 2:
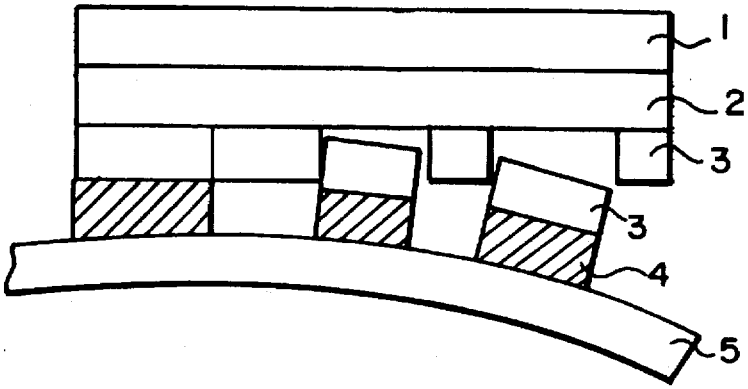
FIG. 2 shows selective transfer from the dye donor transfer sheet in contact with a photocopy or other thermoplastic sheet after heating.

FIG. 1 shows a dye donor sheet consisting of a sublimation dye resisting substrate (1) made for example of polyester. Coated onto it is a release coat (2), and coated on to that is a layer of sublimation dye (3) which has a bonding medium which when placed in contact with a photocopy or other thermoplastic print, and subjected to heat, will adhere selectively to the thermoplastic printed areas as shown in FIG. 2. The thermoplastic ink is indicated as (4), and (5) shows the paper on which it is printed. For example (4) and (5) could be a photocopy or a laserprinter copy where thermoplastic toners are used.

The release coat is an optional extra and need not be provided. In the case where no release layer (2) is provided, the layer of sublimation dye is formed by mixing in a ball mill the following ingredients:

10 g sublimation dye powder (SUBLAPRINT)

42 g zinc oxide powder 63 g water 35 g GLASCOL LE19

2.5 g Ammonia at 35% strength

SUBLAPRINT sublimation dye powder is available from Holliday Dyes and Chemicals Ltd, Huddersfield, West Yorkshire, England and GLASCOL LE19 is a water-based acrylic copolymer adhesive available from Allied Colloids Ltd, Bradford, West Yorkshire, England.

The sublimation dye layer is coated at a basis weight of 7 g/m$^2$.

Where a release layer (2) is provided, the sublimation dye layer is formed in exactly the same way, but the substrate (1) is precoated with 2 g/m$^2$ of a ball-milled mixture of the following ingredients:

20 g GLASCOL LE19

60 g zinc oxide powder 70 g water

This precoat forms the release layer.

The resultant photocopy with dye adhering to the print is now a sublimation dye transfer sheet and can be used in the conventional way as described in the introduction.

Figure 3:
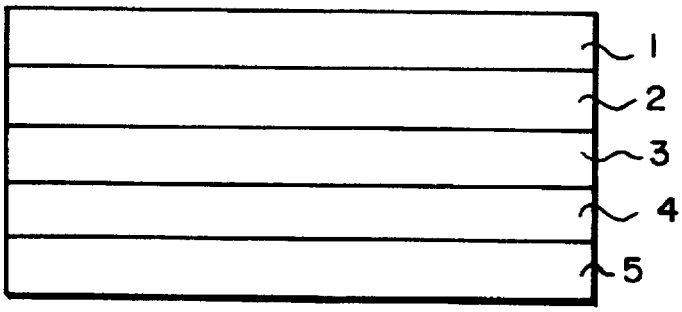
FIG. 3 is a sublimation dye donor transfer sheet including a barrier

In order that the thermoplastic print does not flow through the dye layer and mark the surface being dye printed during the heating process, a barrier layer and an adhesive layer may be added as Shown in FIG. 3.

FIG. 3 shows a sublimation dye resisting substrate eg polyester etc (1), optional dye release layer (2), a dye layer (3) and a barrier layer (4), (ie, a layer which will prevent the thermoplastic print from the photocopy flowing through the dye layer onto the surface being dye printed during application of heat). One such barrier material could be aluminium which may be vacuum deposited. An adhesive layer (5) is also shown. This is compatible with the thermoplastic print areas only, and adheres to the print when subjected to heat and pressure but not to the paper.

Figure 4:
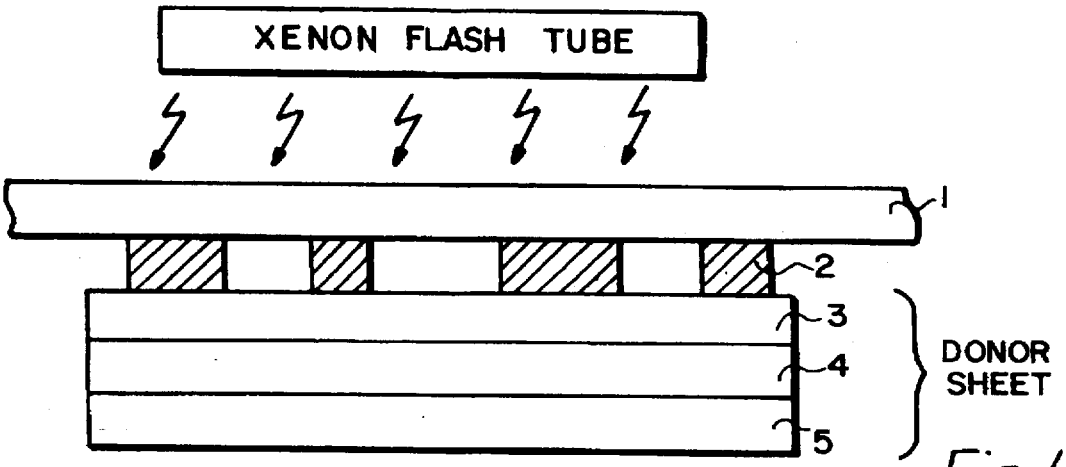
FIG. 4 shows heating the dye layer of the transfer sheet with radiation from an xenon flash.
Figure 5:
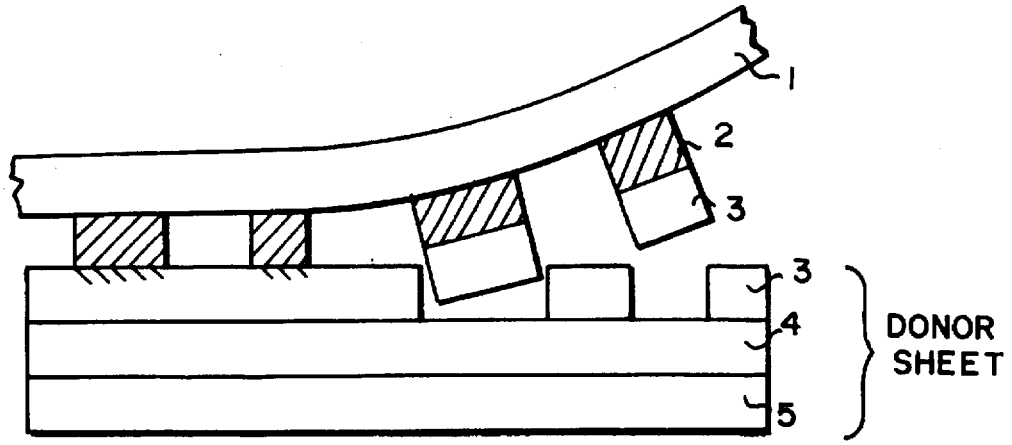
FIG. 5 shows dye adhering selectively to the photocopy text.

Another feature of this invention is in the use of a transparent, heat resisting, sheet of material such as polyester, used to make a photocopy from which to make the sublimation dye transfer sheet as shown in FIG. 4 and FIG. 5. Any print using a thermoplastic ink onto a transparent sheet may be used in addition to a photocopy.

FIG. 4 shows:—transparent sheet (1) with photocopy text (2) sublimation dye (3), optional release layer (4) and substrate (5). A xenon flash tube is used to heat the photocopy text by radiation so that the dye/bonding material adheres selectively to the photocopy text.

FIG. 5 shows dye adhering selectively to the photocopy text.

Figure 6:
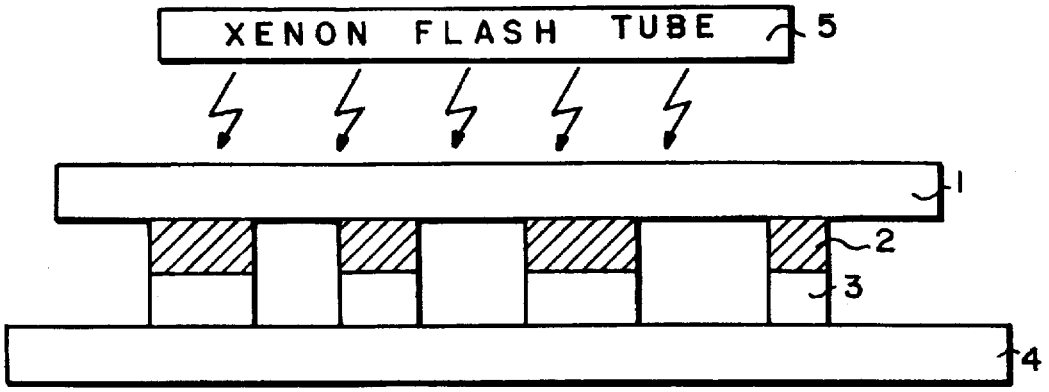
FIG. 6 illustrates a conventional way of subliming the dye into a suitable surface.

The resultant photocopy/dye transfer sheet is then used in a conventional way to sublime the dye into a suitable surface (polyester) or can be used to sublime the dye in the way shown in FIG. 6.

Alternatively, the resultant photocopy/dye transfer sheet is used as follows. In FIG. 6 a xenon flash tube (5) is shown, which is activated over the transparent sheet photocopy dye transfer sheet (1) (2) (3).

The radiated heat from the xenon passes through the transparent sheet (1) and is absorbed by the black toner print (3) which in turn heats the dye (3) by conduction causing the dye to sublime into the surface being printed (4).

This method has a great advantage over the conventional heating method (conduction) which takes approximately one minute. The xenon flash method takes approximately 1 millisecond, so making the process much faster and suitable for a high production method.

It has a further advantage in that there is far less heat distortion caused to the materials being used, indeed the dye transfer sheet and the surface being printed may be a material of relatively low heat resistance as the heat applied is very localised and of small duration.

Another advantage of using transparent dye transfer sheet is that when several colours are used in a printed design, each colour transfer sheet is easily registered in position over previously printed colours by eye. This would be much more difficult if an opaque dye transfer sheet is used. Another feature of this invention is that the used dye donor sheet (not the transfer sheet)—see FIG. 5—can itself be used as a transfer sheet, this would of course give large coloured areas with small blank text areas, it would also give the advantage that if a conventional photocopy (right facing) were used, then the sublimation dye print would also be right facing, ie there would be no need to print a reverse image photocopy.

2. Dye Transfer Sheet Made by Overprinting

The invention also has a method in which a substrate sheet such as paper, is evenly coated with a layer of sublimation dye, which sheet is subsequently overprinted with text or design, the print ink being a material which will inhibit the dye from subliming to the surface being dye printed.

Figure 7:
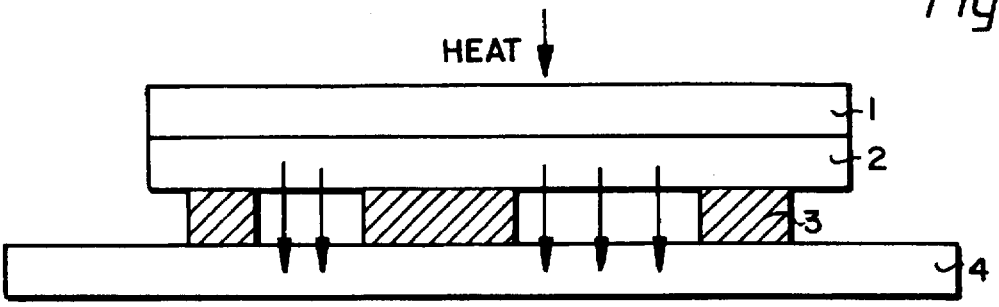
FIG. 7 shows the use of a text or design overprint to inhibit dye from subliming into the surface being dyed.

FIG. 7 shows a substrate sheet (1) coated with a layer of sublimation dye (2) subsequently overprinted (3) with a material which inhibits the dye from sublimating into the surface being printed (4).

Figure 8:
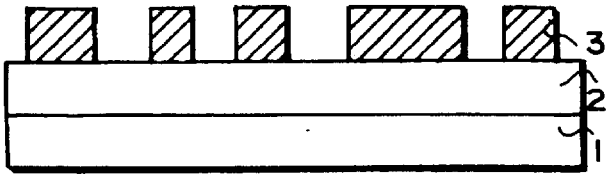
FIG. 8 shows the dye coated substrate overprimed by photocopying with a thermoplastic toner.

Alternatively a similar effect can be achieved as shown in FIG. 8, in which substrate (1) coated with dye (2) is overprinted by photocopying where the print material is thermoplastic toner (3). Other printing methods using thermoplastic materials may be used.

Figure 9:
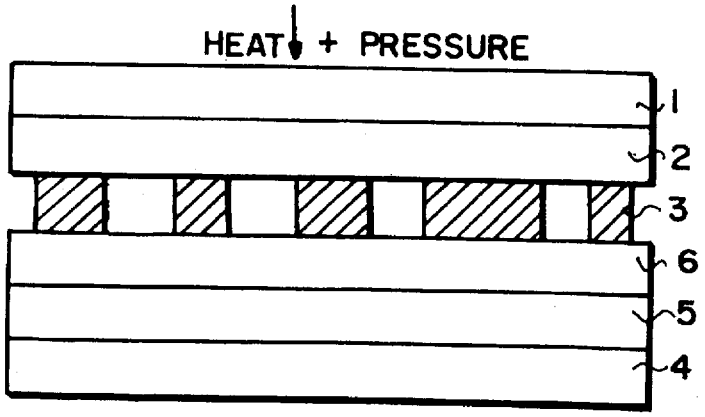
FIG. 9 is a multi-layer structure including a substrate and a sublimation dye inhibiting layer.

FIG. 9 shows the photocopied dye sheet (1) (2) (3) placed in contact under pressure and heat with a doner sheet. In FIG. 9 (4) is a paper or polyester substrate, (5) is a optional release layer preferably transparent and (6) is a sublimation dye inhibiting layer, for example vacuum deposited aluminium. An adhesive compatible to the toner print when heated also may be coated over the inhibition layer (6) to improve subsequent adhesion.

Figure 10:
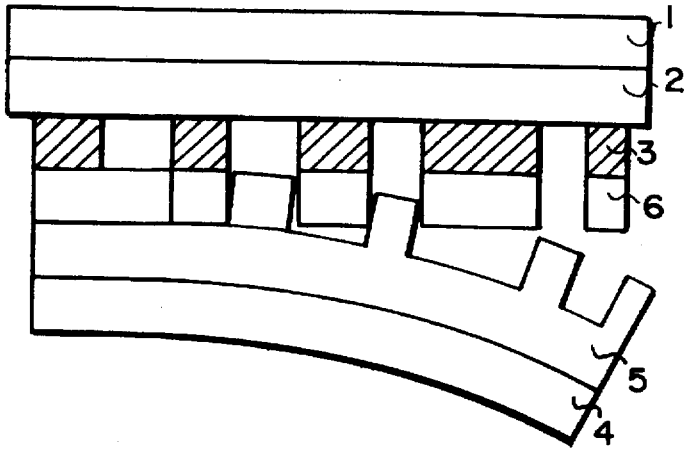
FIG. 10 shows the inhibiting layer selectively adhering to the photocopy print areas.

FIG. 10 shows the inhibiting layer (6) selectively adhering to the photocopy print areas (3).

Figure 11:
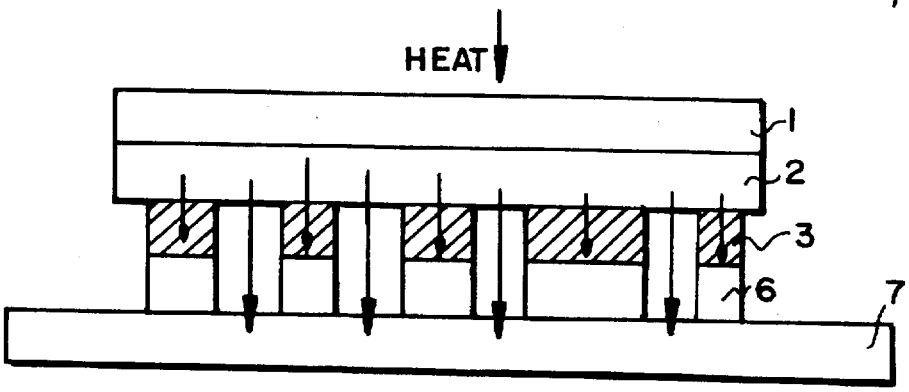
FIG. 11 shows the use of the photocopied dye sheet as a sublimation dye transfer sheet.

The photocopied dye sheet (1) (2) (3) (6) then becomes a sublimation dye transfer sheet and can be used as shown in FIG. 11.

FIG. 11 shows the dye transfer sheet being heated whilst in contact with the sheet being dye printed (7).

The dye (2) is inhibited from subliming in the selected areas of toner (3) coated with inhibiting material (6) thus printing the desired design onto (7).

3. Dye Sublimation Through Transfer Substrate Sheet

Figure 12:
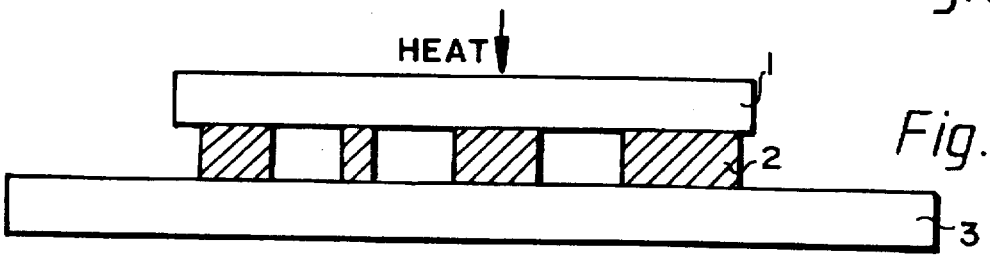
FIG. 12 illustrates sublimation dye transfer on application of heat onto a substrate.

In conventional sublimation dye printing, the transfer sheet is printed with sublimation dye with the design back to front, so that when the transfer sheet is placed with the printed design next to the surface being sublimation printed, the transferred design is the right way round, see FIG. 12.

FIG. 12 shows the sublimation dye transfer consisting of substrate sheet (1) which is typically paper, and the sublimation dye design (2) printed back to front. The surface being printed, typically polyester, is shown as (3).

To overcome the problem of the need to print the transfer design back to front, the following novel methods are proposed:

In the first method the sublimation dye transfer is made by printing the dye design the right way round onto a sheet of material which will readily allow the dye to pass through it when subjected to heat, into the surface to the sublimation dye printed. Such a material may be polyester as manufactured by ICI typically of a thickness approximately 20 microns. Thus the image would be printed the right way round, see FIGS. 13 and 14.

Figure 13:
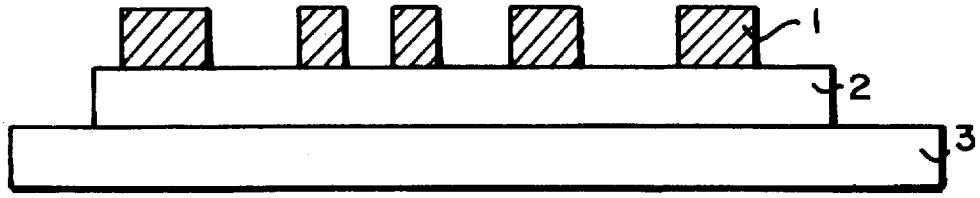
FIG. 13 is another embodiment with the sublimation dye printer right way round on a polyester sheet.

FIG. 13 shows the polyester sheet (2) printed the right way round with sublimation dye (1) placed onto the sheet to be sublimation dye printed (3).

Figure 14:
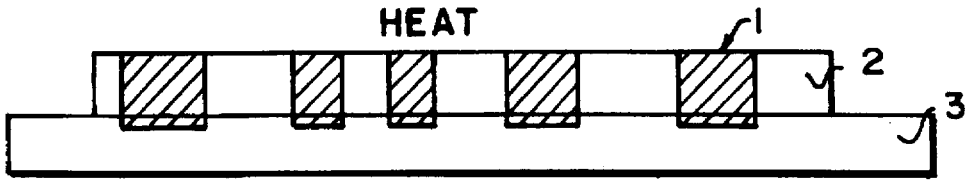
FIG. 14 shows the production of a fight way round print.

FIG. 14 shows the transfer sheet (1) (2) placed with its imprinted surface next to the surface to be sublimation printed (3) thus producing a right way round print.

A second method consists of a substrate sheet which will allow sublimation dye to pass through it readily, for example polyester sheet of for example 20 microns thickness. This sheet is coated with a uniform layer of sublimation dye on one side. The opposite side of the sheet is coated with a layer of material which inhibits sublimation dye from passing through it, for example aluminium foil, or vacuum deposited aluminium. This coating also would have the property of being selectively removable in required areas, ie text or other designs, see FIGS. 15 and 16.

Figure 17:
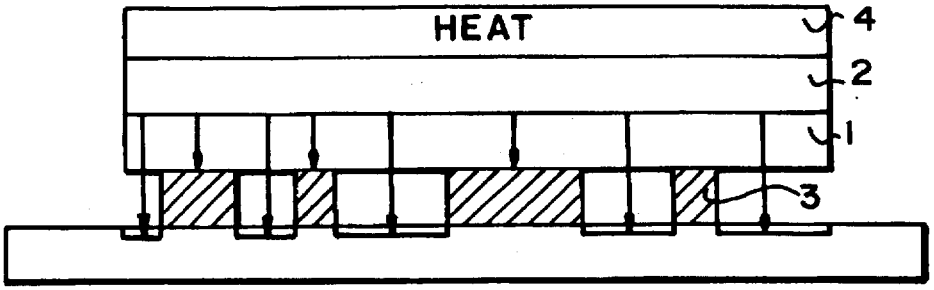
FIG. 17 illustrates printing the desired text or design.

This allows dye to pass through the polyester sheet only in the areas where the inhibiting layer has been removed, and thus sublime into the surface being printed to the desired text or design, see FIG. 17.

Figure 15:
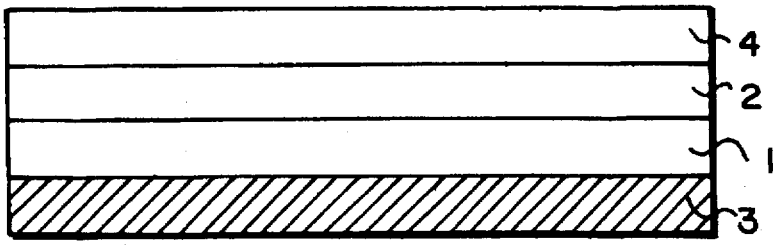
FIG. 15 illustrates the use of a substrate allowing sublimation dye to pass through it.

FIG. 15 shows a substrate sheet (1) made for example of 20 micron thick polyester, coated with a layer of sublimation dye (2) and a layer of sublimation dye inhibiting material (3) which can be selectively removed. A backing sheet is provided, resistant to sublimation dye (4) made for example of paper or aluminium.

Figure 16:
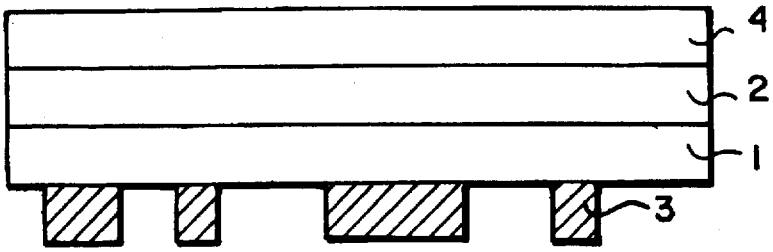
FIG. 16 shows the sublimed dye pattern.

FIG. 16 shows the dye inhibiting layer (3) selectively removed.

FIG. 17 shows dye (2) passing uniformly through sheet (1) being inhibited selectively by layer (3) and subliming into the surface being printed (5) to give desired design, when subjected to heat as shown.

The sublimation dye inhibiting layer (3) could for example be of vacuum deposited aluminium, or an aluminium foil laminated to the polyester sheet (1). The dye inhibiting layer (3) could be selectively removed in a number of ways including, chemical etching, laser evaporation, electrolytic etching, etc or by selective adherence to another surface ie removed by sticking to text or other design which is adhesive to the dye inhibiting layer.

A proposed example of this is shown in FIGS. 18 to 21.

Figure 18:
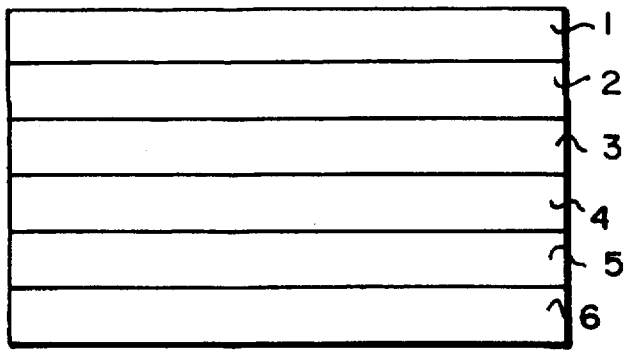
FIG. 18 shows a multi-layer dye laminate.

FIG. 18 shows a dye laminate sheet consisting of a substrate sheet (1) of for example paper or aluminium, a layer of sublimation dye (2), a polyester sheet (3), say 20 microns thick, an optional release coating (4) identical to that disclosed in section 1, a sublimation dye inhibiting layer (5), eg vacuum deposited aluminium, and an adhesive layer (6) which will stick to a thermoplastic material softened by heat, eg photocopy toner text, but will not stick to the photocopy paper.

Figure 19:
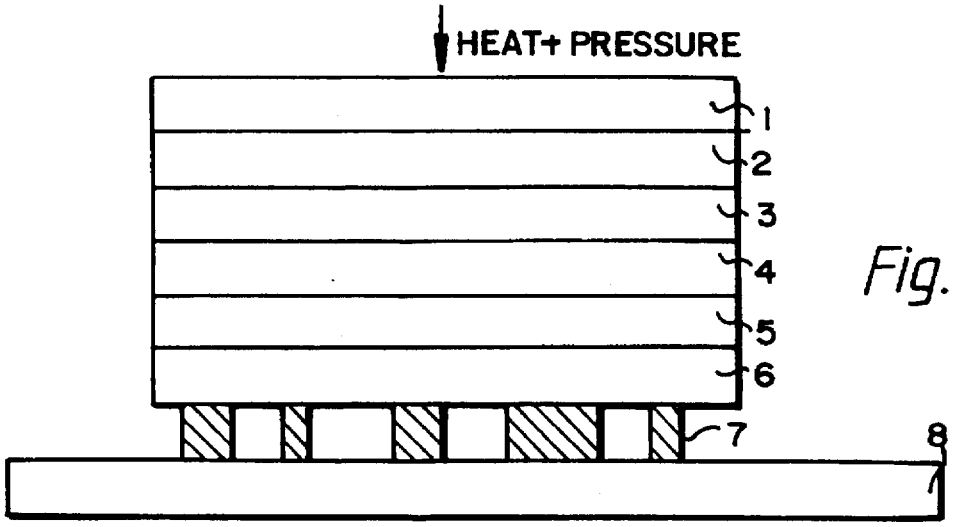
FIG. 19 depicts the dye laminate sheet of FIG. 18 placed with adhesive layer next to the printed side of a photocopy containing thermoplastic toner text thereon.

FIG. 19 shows the dye laminate sheet 1 to 6, placed with its adhesive layer (6) next to the printed side of a photocopy, where (7) is a thermoplastic toner text or design, and (8) is the photocopy paper.

These are subjected to heat and pressure so that the toner (7) softens and adheres to the adhesive (6).

Figure 20:
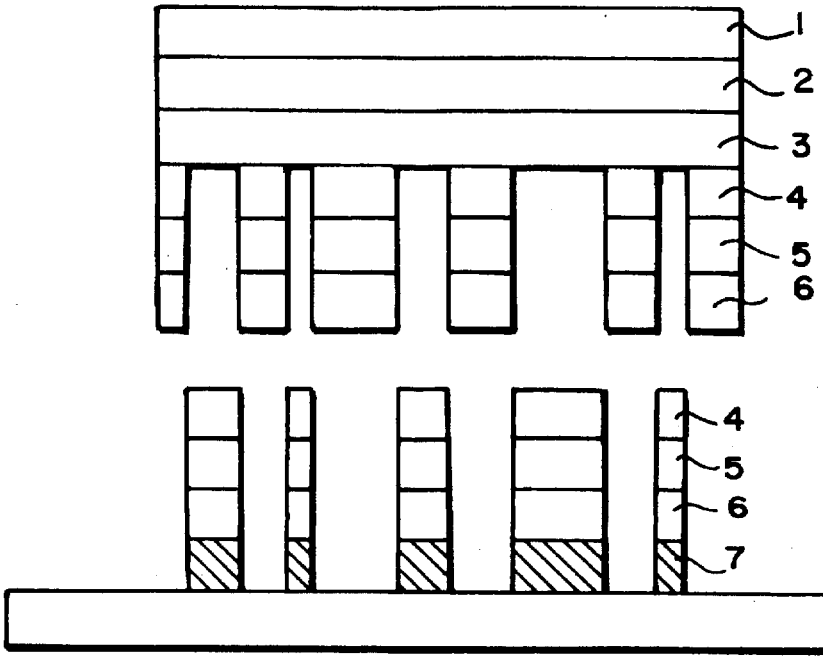
FIG. 20 depicts the resulting dye laminate sheet used as a dye transfer sheet.

When the dye laminate sheet is then separated from the photocopy sheet, selected areas of layers (4), (5) and (6) are removed from the laminate as shown in FIG. 20.

Figure 21:
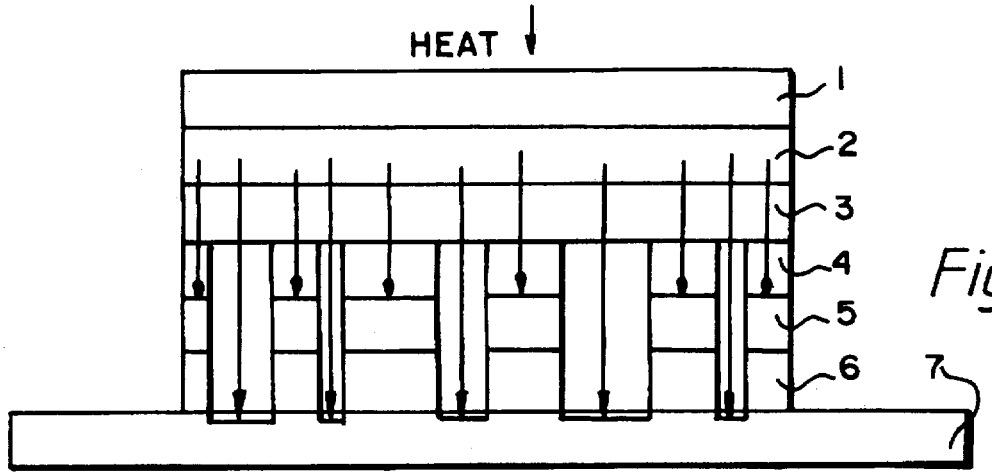
FIG. 21 shows the resultant dye laminate sheet placed next to the surface to be sublimation printed and subjected to heat.

The resultant dye laminate sheet shown in FIG. 20 is then used as a dye transfer sheet in the conventional way to produce a print a shown in FIG. 21.

FIG. 21 shows the resultant dye laminate sheet 1 to 6 placed next to the surface to be sublimation printed (7) and subjected to heat.

The dye (2) passes uniformly through the polyester sheet 93) and the release layer (4), but will not pass the dye inhibiting layer (5). Where the inhibiting layer has been selectively removed the dye will pass through the gaps to the surface (7) thus printing the desired design.

Other combinations of dye, inhibitor, substrates could be formulated to those skilled in the art once this principle is recognised.

4. Dye/Substrate/Inhibition Layer—Laminate

Figure 22:
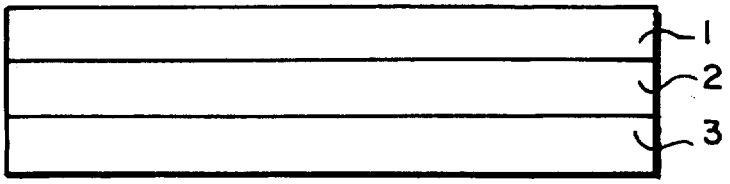
FIG. 22 illustrates another embodiment of a dye substrate and a dye inhibitor layer.

Another novel method associated with the present invention is shown in FIG. 22.

FIG. 22 shows a sublimation dye resisting substrate (1) made for example from paper. A sublimation dye layer (2), and a dye inhibiting layer (3) made from a material which can be selectively removed, for example aluminium.

Figure 23:
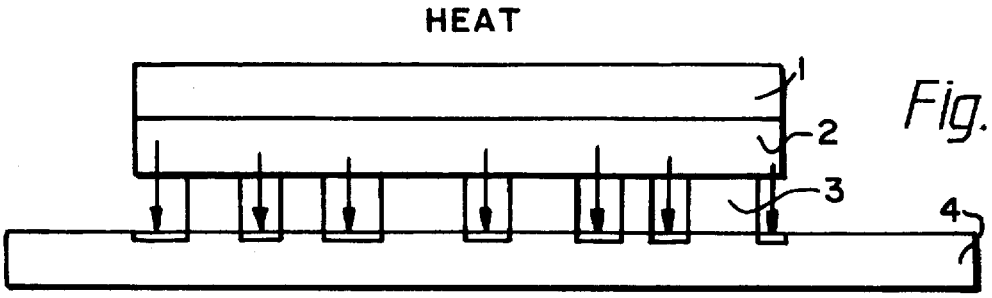
FIG. 23 shows the use of the laminate of FIG. 22.

In use the inhibiting layer (3) would be selectively removed, for example by chemical etching, electrolytic action, spark erosion etc the areas removed would be in the shape of text or other desired designs. The resultant laminate may be used in a conventional way as shown in FIG. 23.

FIG. 23 shows:

Dye (2) will pass through the gaps in the inhibiting layer (3) to sublimate into the surface being printed (4) when subjected to heat. (Alternatively the substrate (1) in FIG. 22 could be made of a transparent material which ideally is resistant to sublimation dye.)

Figure 24:
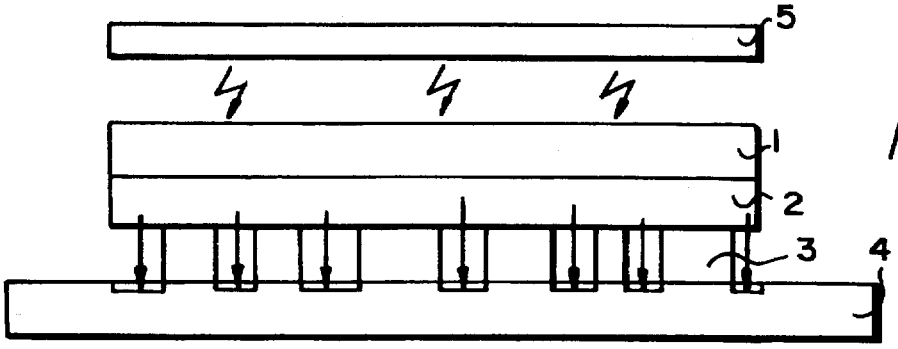
FIG. 24 shows printing after the inhibiting layer is selectively removed.

After the inhibiting layer (3) is selectively removed the resultant laminate could be used to print as shown in FIG. 24.

FIG. 24 shows the laminate with the dye inhibiting layer (3) selectively removed. A xenon lamp (5) is activated, the heat from which passes through the transparent substrate (1) to heat the dye layer (2) causing it to pass through the gaps in the inhibiting layer (3) to sublimate into the surface being printed (4). It may be advantageous to have a layer of heat absorbing material between the substrate (1) and the dye layer (2). This could be for example a black cotton or similar material bonded in a medium such that it would adhere to the substrate and to which the dye layer would adhere.

This heat absorbing layer would absorb the heat from the xenon tube and transmit it to the dye layer by conduction, this would be particularly useful where light coloured dyes such as yellow were used which would otherwise reflect the heat from the xenon.

Alternatively, a heat absorbing material such as cotton black may be mixed with the layer of dye/bonding material.

5. producing dye transfer sheet by Inhibition Printing Substrate

Another novel method associated with the invention, involves the printing of a substrate sheet with a material which will subsequently inhibit the acceptance of the sublimation dye in the printed areas.

Figure 25:
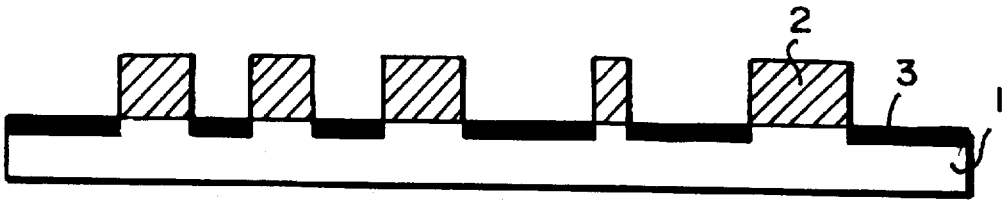
FIG. 25 illustrates a dye transfer sheet produced by inhibition printing.

FIG. 25 shows a substrate sheet (1) made of a material that will accept the sublimation dye (3) printed with a material which will inhibit the dye, ie the dye is repelled from it.

An example of suitable materials would be to use a substrate (1) made from paper, and to print the desired text or design onto it with a wax based ink which will repel water. This printed sheet is then coated with a water based sublimation dye, the areas printed with the wax material remaining free of dye. Other combinations of accepting and repelling materials may be used. The resultant coated sheet is then used as a transfer sheet in a conventional way to make a sublimation dye print, see FIG. 26.

Figure 26:
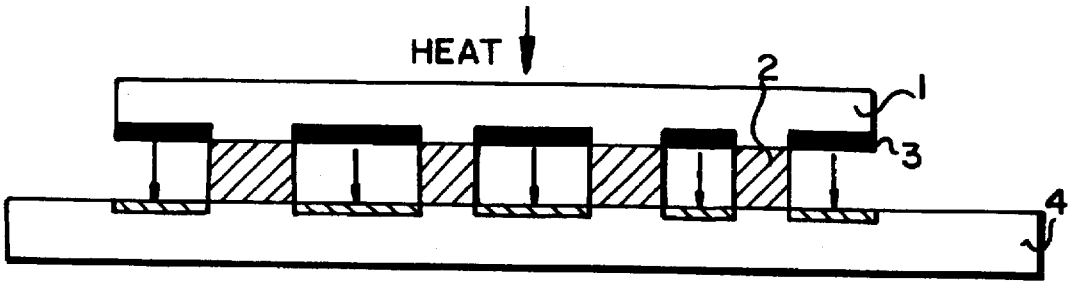
FIG. 26 shows surface 4 being sublimed onto the substrate below in a conventional sublimation dye print.

FIG. 26 shows surface (4) being sublimation dye printed.

Figure 27:
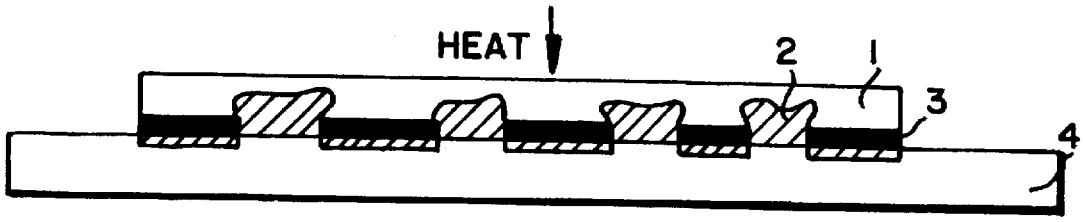
FIG. 27 shows a paper substrate with wax printed areas coated with dye in which the underlying sheet is sublimation dye printed.

It has been found that if a wax material is used to print the substrate as described, the wax (2), during the heating process, liquifies and wicks into the paper substrate 91) as shown in FIG. 27.

FIG. 27 shows a paper substrate (1), with wax printed areas (2) coated with dye (3). The sheet (4) is being sublimation dye printed.

This wicking of the wax into the paper substrate has the advantage that the dyed areas are brought into closer contact with the surface being printed (4) giving a better resolution of the designs being printed. It also reduces the risk of the wax being deposited onto the surface being printed.

This method of making a dye transfer sheet is very advantageous when large areas of dye are required.

I claim:

1. A dye donor sheet comprising a dye resisting substrate, a release layer coating thereon, on which is coated a continuous layer of sublimation dye which is coated over substantially the entire surface of the release layer and incorporating at least in its surface a bonding medium which is capable of causing the dye to adhere to the thermoplastic print of a printed sheet placed in contact with the layer of dye and subjected to heat and pressure, thereby to produce a dye transfer sheet.

2. A dye donor sheet according to claim 1 having a dye barrier layer over the layer of sublimation dye and an adhesive to thermoplastic material and not to paper coated over the barrier layer.

3. A dye donor sheet according to claim 1 wherein the dye resisting substrate is transparent.

* * * * *